US007392782B2

(12) United States Patent
Fujii

(10) Patent No.: US 7,392,782 B2
(45) Date of Patent: Jul. 1, 2008

(54) PROTECTIVE DEVICE FOR EXTERNAL COMPONENTS OF ENGINE

(75) Inventor: Takeshi Fujii, Kawasaki (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 558 days.

(21) Appl. No.: 11/166,393

(22) Filed: Jun. 27, 2005

(65) Prior Publication Data

US 2006/0005800 A1 Jan. 12, 2006

(30) Foreign Application Priority Data

Jul. 6, 2004 (JP) ..... 2004-199246

(51) Int. Cl.
*F02B 77/08* (2006.01)
*F02F 7/00* (2006.01)

(52) U.S. Cl. ..... 123/198 D; 123/195 C; 180/232

(58) Field of Classification Search ..... 123/195 C, 123/198 D, 198 E; 180/232
See application file for complete search history.

(56) References Cited

U.S. PATENT DOCUMENTS 6,569,509 B1 * 5/2003 Alts ..... 181/284

FOREIGN PATENT DOCUMENTS

JP 11-210488 A 8/1999
JP 2006322346 A * 11/2006
JP 2007016716 A * 1/2007

* cited by examiner

*Primary Examiner*—Noah Kamen
(74) *Attorney, Agent, or Firm*—Foley & Lardner LLP

(57) ABSTRACT

An engine component (2, 3) is disposed in front of or behind the vehicle engine with respect to the direction of vehicle travel. The component (2, 3) is covered by a protective shell (10) from an opposite direction from the engine (1). The protective shell (10) is fixed to the engine (1) by brackets (5, 6). Stoppers (11-13) in the protective shell (10) limit the displacement of the protective shell (10) towards the engine (1) from exceeding a predetermined distance. The brackets (5, 6) are provided with deformable members (5, 6A) which deform in response to an impact load applied to the protective shell (10) and guide the protective shell (10) only in a direction towards the engine (1) up to the position which is limited by the stoppers. In this manner, the protective properties of the external components (2, 3) with respect to an impact load is enhanced.

10 Claims, 10 Drawing Sheets

PROTECTIVE DEVICE FOR EXTERNAL COMPONENTS OF ENGINE

FIELD OF THE INVENTION

This invention relates to the protection of externally-fitted components (hereafter "external components") of an internal combustion engine for a vehicle.

BACKGROUND OF THE INVENTION

Tokkai Hei 11-210488 published by the Japan Patent Office discloses a protective device for protecting external components of an internal combustion engine for a vehicle from suffering damage during a vehicle collision.

According to this prior art, an internal combustion engine is disposed along the longitudinal center plane in the front section of a vehicle. In other words, the engine is disposed so that the crank shaft is substantially parallel to the vehicle axle. An external component such as a fuel pump is fitted to the front face of the internal combustion engine. One end of a high-temperature pipe for cooling water is connected to the engine. The cooling water pipe is highly rigid and circulates cooling water from the engine to a radiator which is positioned in front of the engine. The other end of the high-temperature cooling water pipe is connected to the radiator after crossing the front face of the fuel pump so that the fuel pump is protected.

A muffler cover covering the fuel pump is respectively fixed to a cylinder head cover covering the cylinder head of the engine 1 and the high-temperature cooling water pump. The muffler cover muffles noise from the pump. Furthermore when the vehicle experiences a collision, the muffler cover reduces the impact load applied to the fuel pump.

SUMMARY OF THE INVENTION

To summarize the above, the prior art uses a high-temperature cooling water pipe and a muffler cover as a protector for the fuel pump. However the pattern in which the cooling water pipe and the muffler cover deform and displace varies with respect to the initial position and size of an impact load when the vehicle experiences a collision. Consequently there is the possibility that the fuel pump will unexpectedly be damaged as a result of deformation or displacement of the protector.

It is therefore an object of this invention to improve reliability of the protector with respect to an impact load by limiting the preferred direction of deformation or displacement of a protector resulting from an impact load.

In order to achieve the above object, this invention provides a protective device protecting an engine component disposed in front of or behind the vehicle engine with respect to a direction of vehicle motion. The device comprises a protective shell covering the engine component from an opposite direction from the engine, keeping more than a predetermined distance from the engine component, a stopper limiting displacement of the protective shell towards the engine from exceeding the predetermined distance, and a deformable member deforming in response to an impact load applied to the protective shell and guiding displacement of the protective shell towards the engine up to a position limited by the stoppers.

The details as well as other features and advantages of this invention are set forth in the remainder of the specification and are shown in the accompanying drawings.

DESCRIPTION OF THE PREFERRED EMBODIMENTS

Figure 1:
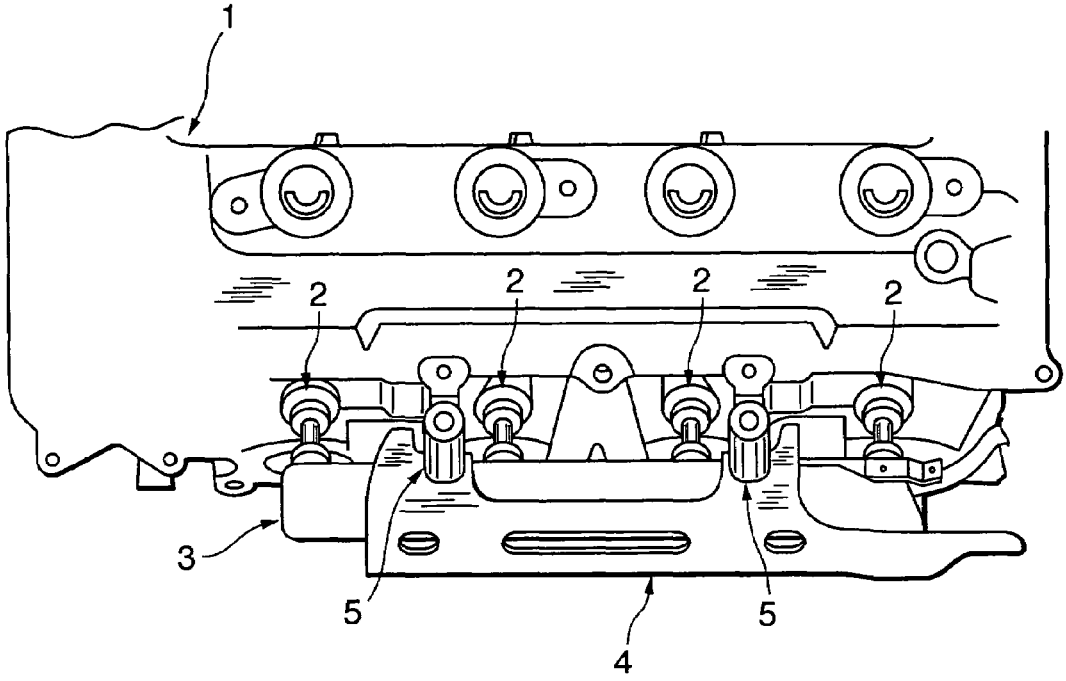
FIG. 1 is a plan view of the essential parts of an internal combustion engine fitted with a protective device according to this invention.

Referring to FIG. 1 of the drawings, a four-cylinder internal combustion engine 1 for a vehicle is a transverse-mounted engine. In other words, the engine 1 is disposed so that the crank shaft is substantially parallel to the vehicle axle.

A fuel supply device is disposed on the front face of the engine 1. The fuel supply device is a so-called common rail fuel supply device and comprises four fuel injectors 2 injecting fuel in a sequential manner in each cylinder. The fuel is supplied under a constant pressure from a fuel supply pipe 3 comprising the common rail. The protective device for external components according to this invention has the object of protecting the fuel supply device as an example of an external engine component. The downward direction of FIG. 1 corresponds to the direction in which the vehicle normally runs.

Figure 2:
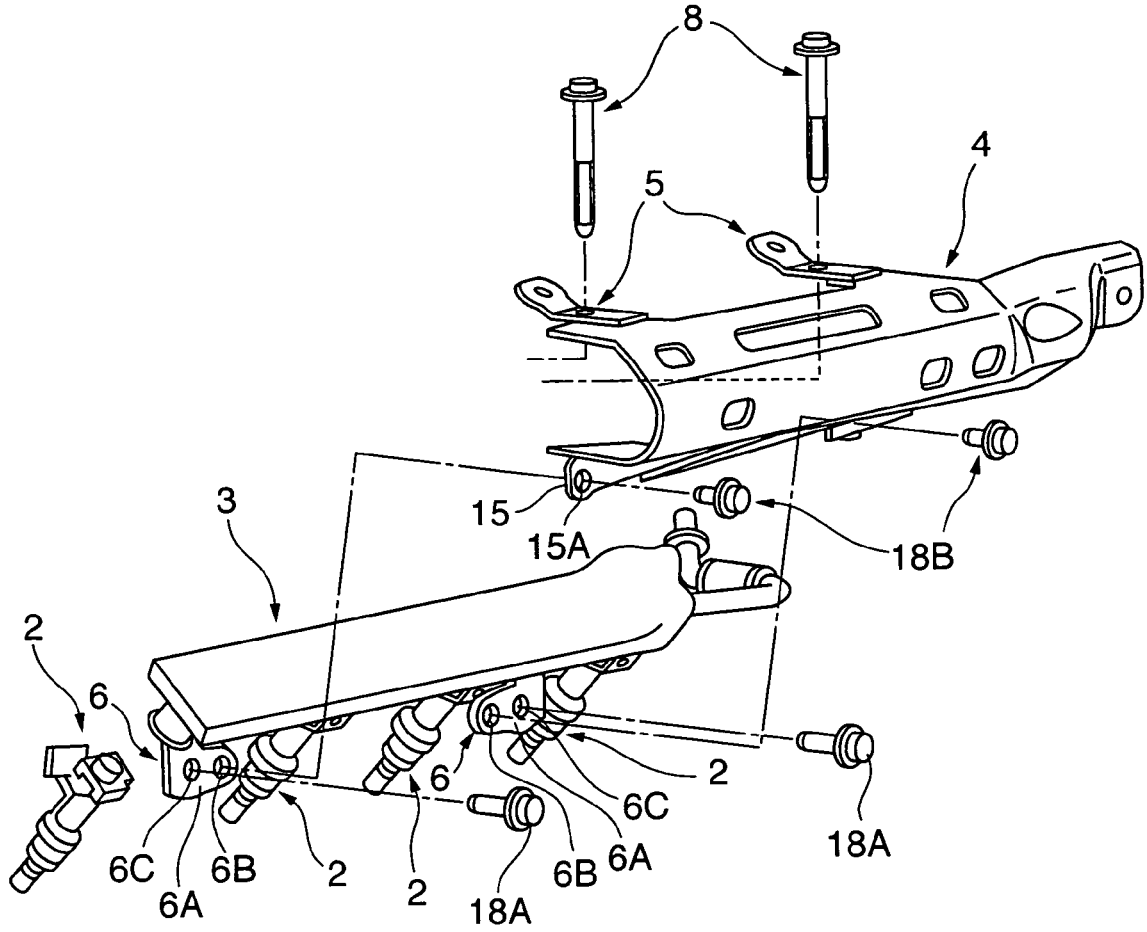
FIG. 2 is an exploded transverse view of the protective device and fuel injection device protected thereby.
Figure 3:
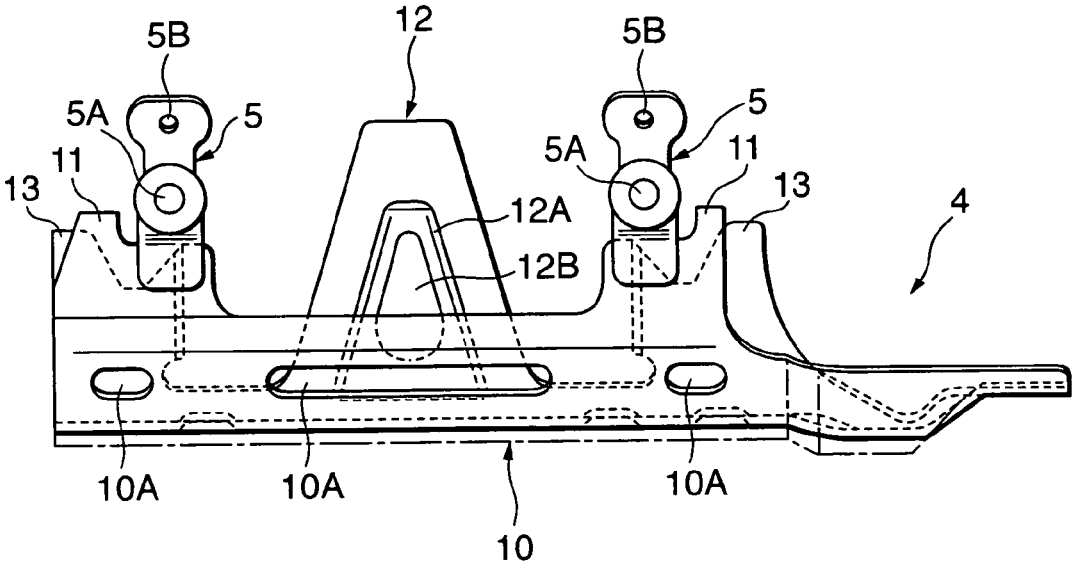
FIG. 3 is a plan view of the protective device.

Referring now to FIG. 2, the protective device comprises a protector 4, a pair of brackets 5 and a pair of brackets 6.

The protector 4 covers the four fuel injectors 2 and the fuel supply pipe 3 distributing fuel to the fuel injectors 2. The upper end and lower end of the protector 4 are fixed to the engine 1 respectively through the brackets 5 and brackets 6.

Referring to FIGS. 3-6, the protector 4 comprises a protective shell 10, a pair of upper stoppers 11, a pair of sub-stoppers 13 and a lower stopper 12 which are integrally formed of a highly rigid material.

The protective shell 10 has a cross-section in the shape of the letter "U" and has an opening facing the engine 1. The pair of upper stoppers 11 projects from the upper end of the protective shell 10 towards the engine 1. The pair of sub-stoppers 13 project from the lower end of the protective shell 10 towards the engine 1. The lower stoppers 12 project from between the two sub-stoppers 13 on the lower end of the protective shell 10 towards the engine 1. The lower stopper 12 has a substantially trapezoidal planar shape, the width of which narrows towards the engine 1. A hole 12B is formed in the center of the stopper 12 in order to reduce the weight of the component. The periphery of the hole 12B is strengthened by ribs 12A.

Each of the brackets 5 comprises a flat plate and is spot-welded to the upper stopper 11. A bolt hole 5A and a fitting hole 5B for a harness are formed on the bracket 5. The bracket 5 is fixed to the engine by a bolt 8 fitted into the bolt hole 5A. The members comprising the bracket 5 have predetermined dimensions and quality in order to be less rigid than the protector 4. The bracket 5 therefore deforms when a large load is applied by the upper stopper 11. Since the bracket 5 comprises a flat plate, deformation is limited to a fixed pattern such that the bracket 5 is folded at a transverse line crossing the flat plate at a right angle. The bracket 5 refers to the component defined as the "second bracket" in the claims.

A part of the sub-stopper 13 forms a stay 14 which is bent approximately 90 degrees in a downward direction. The tip of the stay 14 is bent approximately 90 degrees outwardly in order to be parallel to the wall face of the main section of the engine 1. The section bent outwardly is referred to as the bending section 15.

Figure 9A:
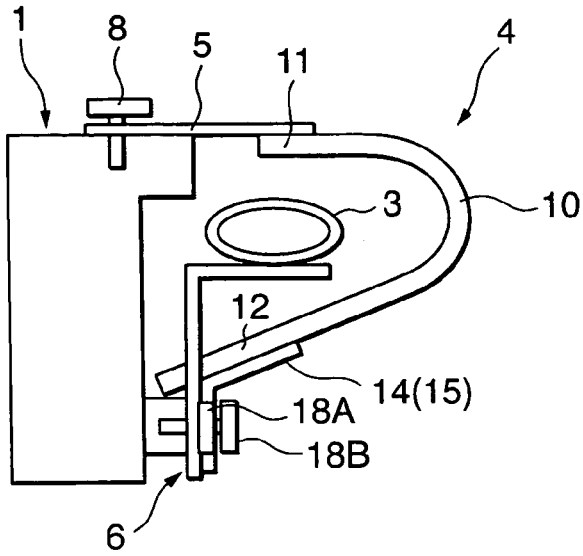
FIGS. 9A and 9B are a schematic cross-sectional view and a schematic horizontal sectional view of the fuel injection device and the protective device mounted on the engine.
Figure 9B:
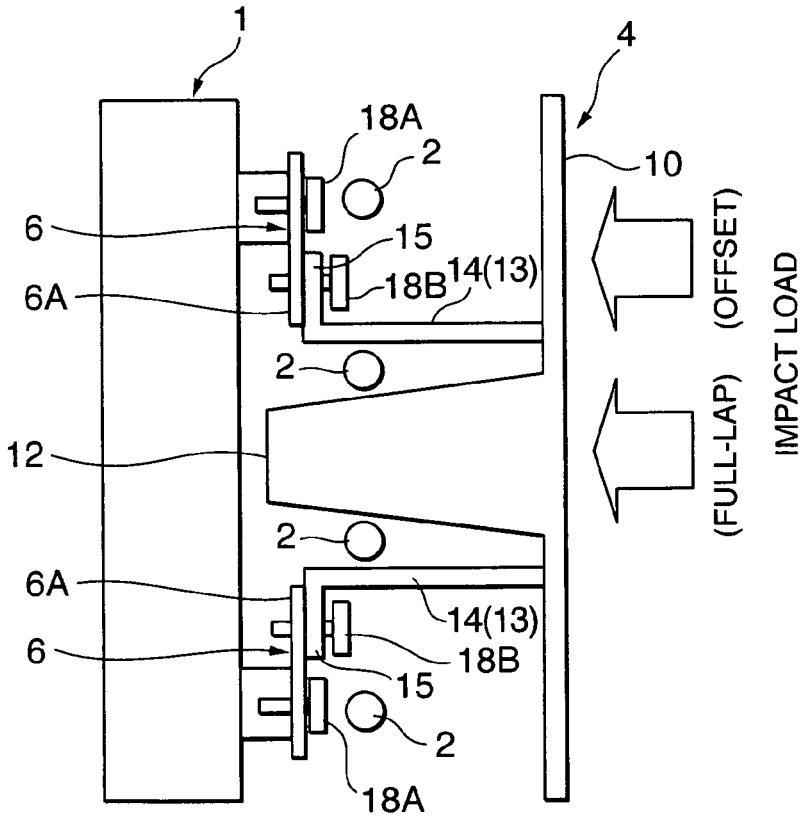

As shown in FIGS. 9A and 9B, the bracket 6 is a member which supports the fuel supply pipe 3. As shown in FIG. 2, the bracket 6 comprises a bolt hole 6C on a face parallel to the wall face of the main section of the engine 1. Referring again to FIGS. 9A and 9B, the bracket 6 is fixed to the projection which protrudes from the wall face of the main section of the engine 1 by a bolt 18A which is fitted into the bolt hole 6C. A tab 6A is formed on the bracket 6 in proximity to the bolt hole 6C. The tab 6A protrudes inwardly, in other words, towards the lower stopper 12.

Figure 4:
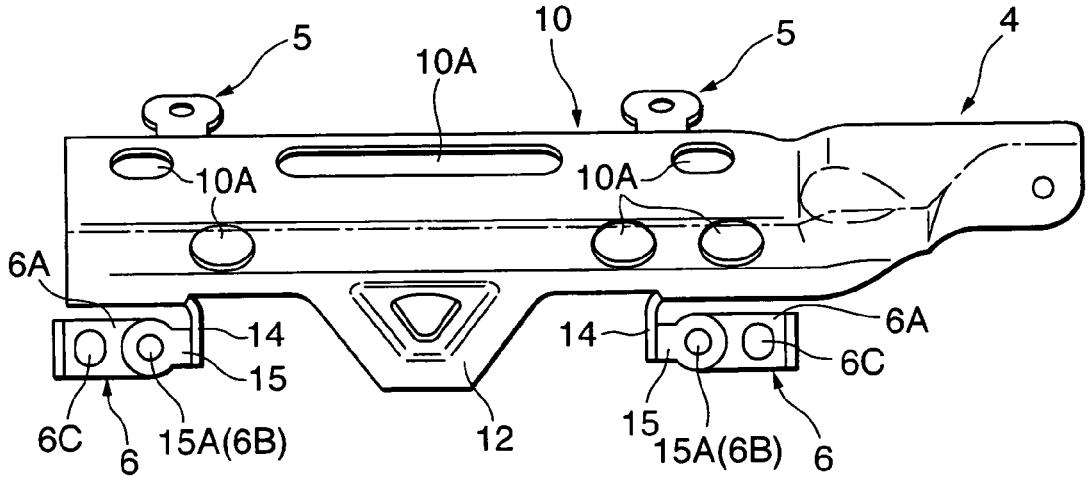
FIG. 4 is a front view of the protective device.
Figure 5:
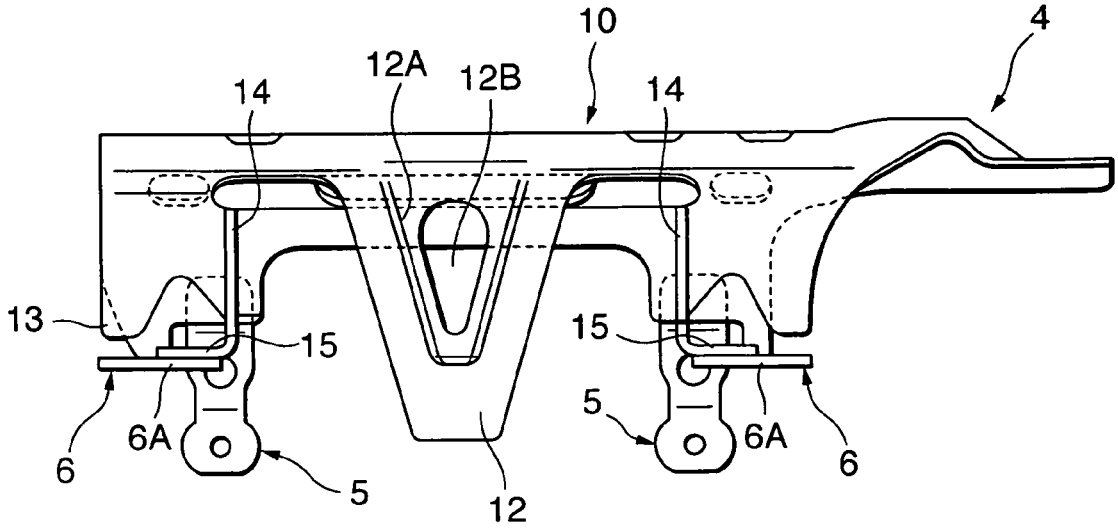
FIG. 5 is a plan view seen from below of the protective device.
Figure 6:
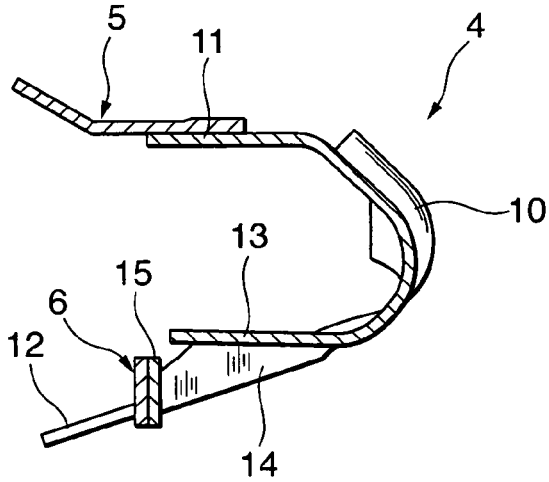
FIG. 6 is a side view of the protective device.

The sub-stopper 13 is fixed to the bracket 6 in the following manner. The bending section 15 of the sub-stopper 13 overlaps with the tab 6A. A bolt 18B is fitted through the bolt hole 15A formed on the bending section 15 and the bolt hole 6B formed on the tab 6A and is fixed by a nut. The tab 6A and the bending section 15 are manufactured to have a rigidity which is lower than the rigidity of the bracket 6 and the protector 4. The tab 6A comprises a section of the bracket 6 and the bending section 15 comprises a section of the sub-stopper 13. However as shown in FIG. 4, the tab 6A protrudes from the bracket 6 and the bending section 15 protrudes from the stay 4.

Thus a variation in the vertical width of the tab 6A and bending section 15 as shown in the figures allows the rigidity of those components to be set to an arbitrary degree while the same material as the bracket 6 or the stay 14 is used. Thus the rigidity of the tab 6A or the bending section 15 can be set to be lower than the bracket 5.

The bracket 6 corresponds to the "first bracket" in the claims. The bracket 5 and the tab 6A/bending section 15 correspond to the "deformable members" in the claims. More precisely, the bracket 5 comprises the upper deformable member and the tab 6A/bending section 15 comprises the lower deformable member.

The protective shell 10 is formed with a predetermined length with respect to the transverse section of the vehicle in order to cover the fuel supply pipe 3. A predetermined gap is formed between the protective shell 10 and the fuel supply pipe 3. A plurality of heat release holes 10A are provided in the protective shell 10 in order to assist in radiating heat from the fuel supply pipe 3 so that the fuel supplied to the fuel injector 2 from the fuel supply pipe 3 does not overheat. The holes 10A are formed at a position which does not adversely affect the rigidity of the protective shell 10. The heat release holes 10A promote heat radiation from the fuel supply pipe 3 and also have the function of reducing the weight of the protective shell 10.

The tip of the stopper 12 differs from the tip of the other stoppers 11 and 13 in that it is not fixed to the engine 1 and is positioned near to the wall face of the main section of the engine 1 as a free end.

The upper stopper 11 is fixed to the engine 1 using the bracket 5. The dimensions of the upper stopper 11 are preset so that the distance from the tip to the wall face of the main section of the engine 1 is smaller than the predetermined gap referred to above. The dimensions of the lower stopper 12 are preset so that the distance from the tip of the lower stopper 12 to the wall face of the main section of the engine 1 is smaller than the predetermined gap. The position at which the lower stopper 12 is formed is the initial point of application of a load during a full-lapped collision.

A full-lapped collision is a vehicle collision with an object which strikes essentially the longitudinal center-plane of the object for protection. An offset collision is a vehicle collision with an object which strikes essentially to one side of the longitudinal center-plane of the object for protection.

The object for protection in this embodiment is a fuel supply pipe 3 and a fuel injector 2. The longitudinal center-plane of the object for protection is positioned between the two inner fuel injectors 2 of the four fuel injectors 2. The lower stopper 12 is formed in this position.

Figure 7:
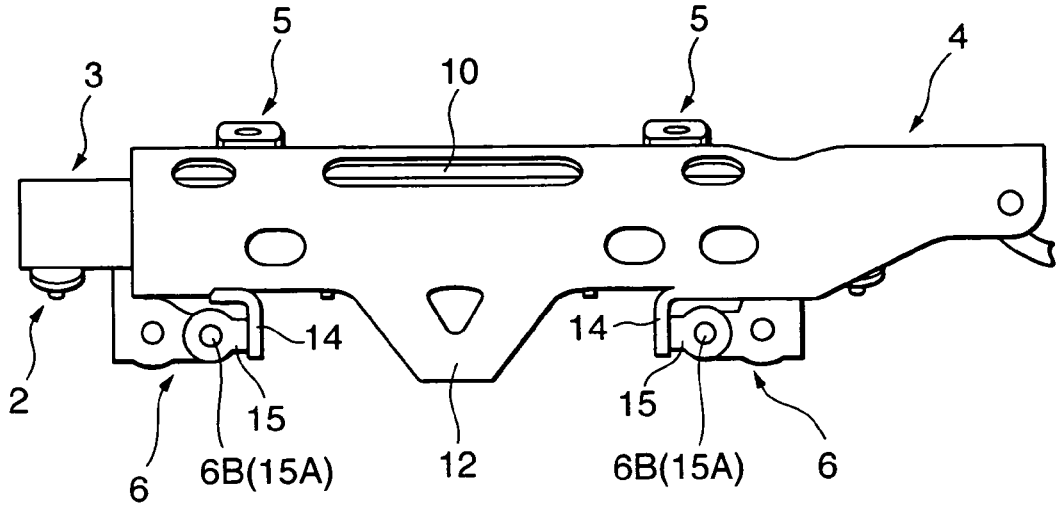
FIG. 7 is a front view of the protective device mounted on the engine.
Figure 8:
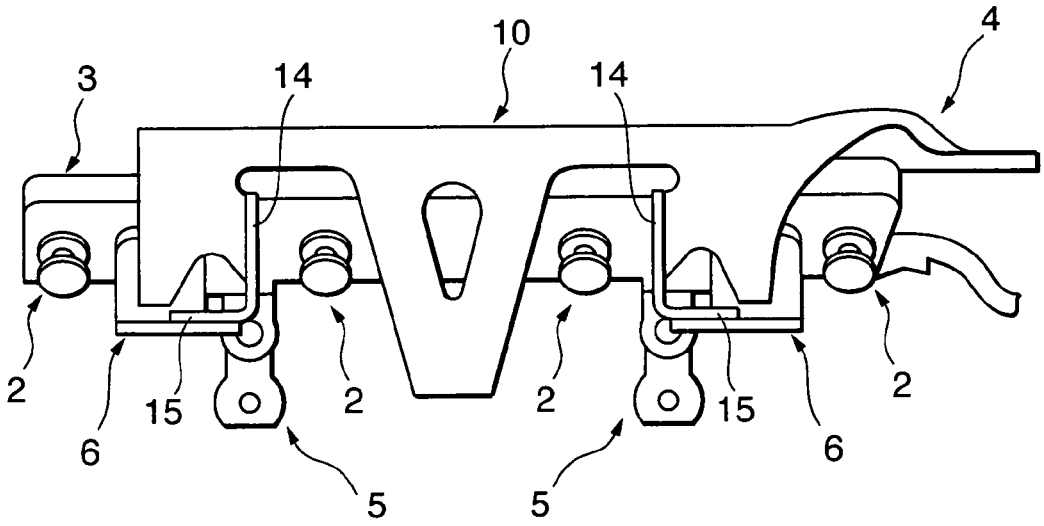
FIG. 8 is a plan view seen from below of the protective device mounted on the engine.

Referring to FIGS. 7 and 8, the protective shell 10 of the protector 4 fixed to the engine 1 in the manner described above is positioned in front of the fuel supply pipe 3 and the fuel injector 2 and covers those two components completely.

In a protective device as constituted above, when the vehicle collides with an object and a impact load is applied to the protector 4, firstly the bracket 5 and the tab 6A deform and the protective shell 10 displaces in a direction towards the engine 1. This displacement is stopped as the upper stopper 11 and the lower stopper 12 abut with the wall face of the main section of the engine 1. The setting of the dimensions as described above means that when the abutment occurs, the protective shell 10 does not come into contact with the fuel supply pipe 3 or the fuel injectors 2. Further load is resisted by the whole of the high-rigidity protector 4 including the upper stopper 11 and the lower stopper 12 which have abutted with the wall face of the main section of the engine 1. Consequently the fuel supply pipe 3 and the fuel injectors 2 are protected.

Next referring to FIGS. 9A, 9B, FIGS. 10A, 10B, FIGS. 11A, 11B, FIGS. 12A, 12B and FIGS. 13A, 13B, the protection mechanism of the protective device will be described with respect to various collision scenarios.

These figures are schematic figures describing the deformation and displacement of members and the point of application of load resulting from a vehicle collision. For the purposes of description, the members have been depicted in either a simplified or an exaggerated form. Thus the dimensions or shape of the members shown in the figures do not always correspond with the other figures.

Referring to FIGS. 9A-9C, the fixing of the protector 4 on the engine 1 is enabled by fixing each of the pair of the upper stoppers 11 using a bolt 8 through the bracket 5 to an upper section of the main section of the engine 1. Furthermore each of the pair of the brackets 6 is fixed using the bolt 18A to a lower part of the main section of the engine 1. The tab 6A of the bracket 6 and the bending section 15 of the stay 14 on the tip of the sub-stopper 13 are fixed using the bolt 18B. The respective tips of the upper stoppers 11 and the lower stopper 12 protrude toward the main section of the engine 1. The interval between the respective projecting ends and the wall face of the main section of the engine 1 is smaller than the interval between the fuel supply pipe 3 and the protective shell 10. The bending section 15 of the stay 14 on the tip of the stopper 13 and the tab 6A of the bracket 6 overlap and are approximately parallel to the wall face of the main section of the engine 1.

As shown in FIG. 9B, the positional relationship of the protective device and the fuel injectors 2 is arranged so that two of the injectors 2 are disposed between the stays 14 of the two sub-stoppers 13 and the lower stopper 12. Each of the other two fuel injectors 2 is disposed on the outer side of each stay 14. The two arrows in the figure show the initial position of the impact load when the vehicle undergoes a full-lap collision or an offset collision.

Figure 10A:
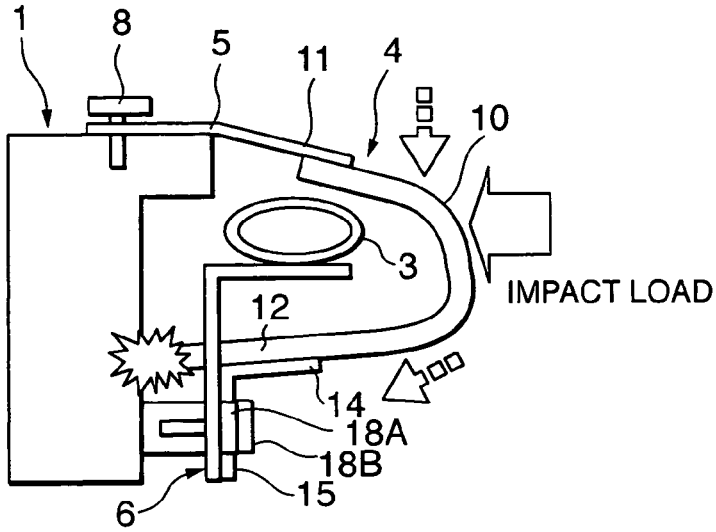
FIGS. 10A and 10B are similar to FIGS. 9A and 9B but show the behavior of the protective device resulting from a relatively small vehicle collision.
Figure 10B:
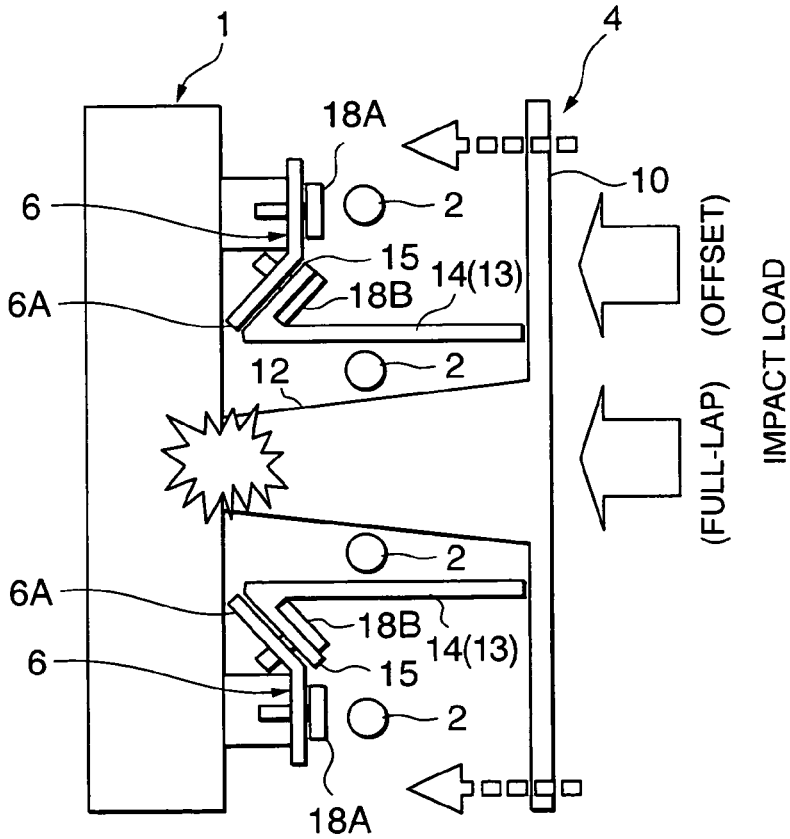

FIGS. 10A and 10B describe the displacement and deformation occurring in a full-lap or an offset collision when a relatively small impact load is applied to the protector 4.

Figure 11A:
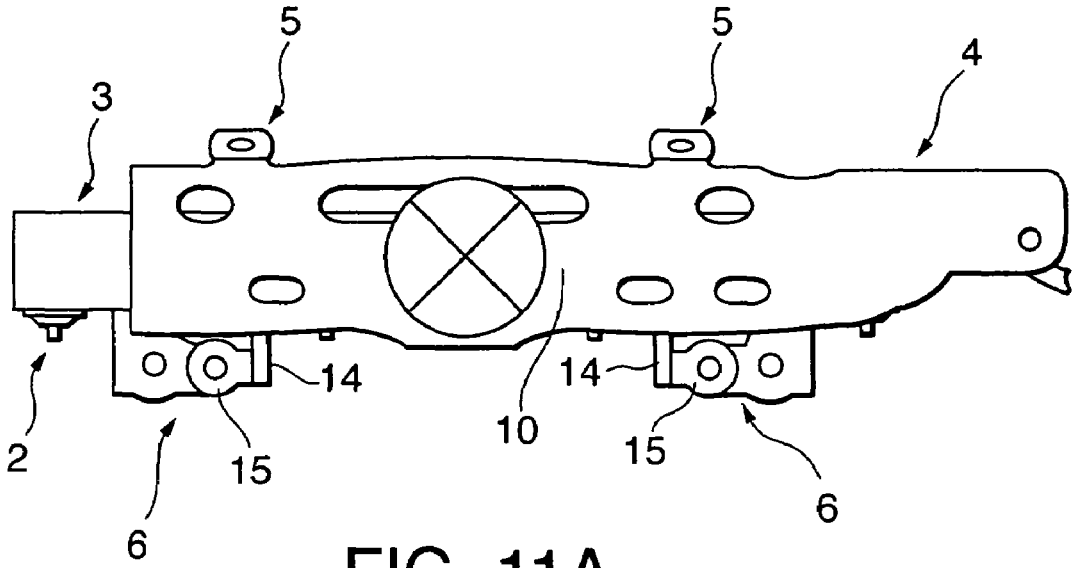
FIGS. 11A and 11B are a front view and a plan view seen from below of the protector showing the path of deformation and displacement of the protective device resulting from a full-lapped collision.

As shown by one of the arrows in FIG. 11A, when a full-lap load is applied to the protective shell 10 of the protector 4, the load as shown by FIG. 9B firstly bends each of the tabs 6A of the brackets 6 through the bending sections 15 of the sub-stoppers 13. In contrast, each of the bending sections 15 is bent into an acute angle on the border with the stay 14. Since the rigidity of the tab 6A and bending section 15 comprising the lower deformable member is set to be lower than the bracket 5 which comprises the upper deformable member, the tab 6A and the bending section 15 undergo a large deformation in advance of other components as a result of the impact load.

As a result, the sub-stoppers 13 approach the engine 1. The protective shell 10 rotates downwardly about the connection point of the engine 1 with the bracket 5 as shown by the broken arrow in FIG. 10A. Accordingly, the bracket 5 is bent downward. The impact load is thus absorbed by the deformation of the tab 6A and bending section 15 as well as the displacement of the protective shell 10. When a larger collision occurs, the stopper 12 abuts with the wall face of the main section of the engine 1 to prevent the protective shell 10 from further approaching the engine 1. In summary, for relatively small impact loads, the protective device absorbs the collision mainly as a result of the deformation of the bending section 15 and the tab 6A comprising the lower deformable member.

At this time, the displacement of the protector 4 shows the direction in which the engine 1 is approached as a result of the pair of tabs 6A and bending sections 15 respectively bending at the ends. In this state, the gap between the protective shell 10 and fuel supply pipe 3 is maintained. Consequently the impact load does not reach the fuel supply pipe 3. The protector 4 can only displace towards the engine 1 since the tab 6A and the bending section 15 deform in a predetermined pattern. As a result, the impact load has no effect on the fuel injectors 2 disposed between the pairs of stays 14 and lower stoppers 12 since the protector 4 does not displace or deform in a transverse direction.

FIGS. 11A, 11B and FIGS. 12A, 12B show the difference in the behavior of the protector 4 during a full-lapped collision and an offset collision.

Figure 11B:
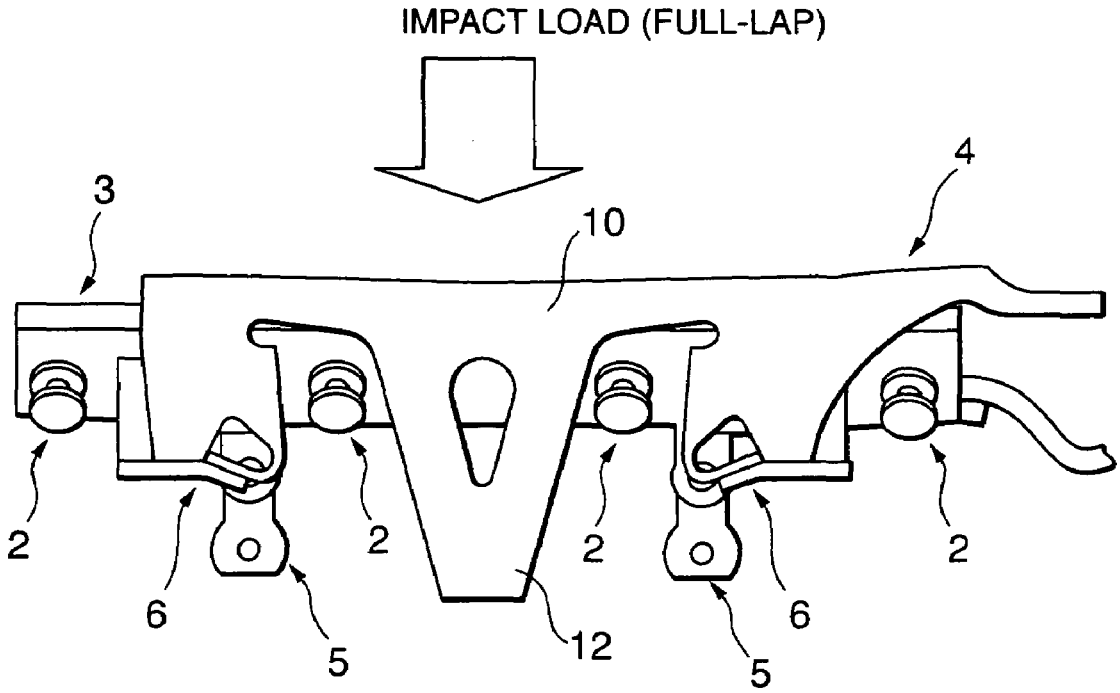

FIGS. 11A and 11B show a full-lapped collision. During a full-lapped collision, as described above, the whole protector 4 undergoes displacement describing a downward slope as shown in FIG. 9A. However the pair of tabs 6A and the bending section 15 deforms uniformly as shown in FIG. 11B as seen from above and the protector 4 remains parallel to the engine 1.

Figure 12A:
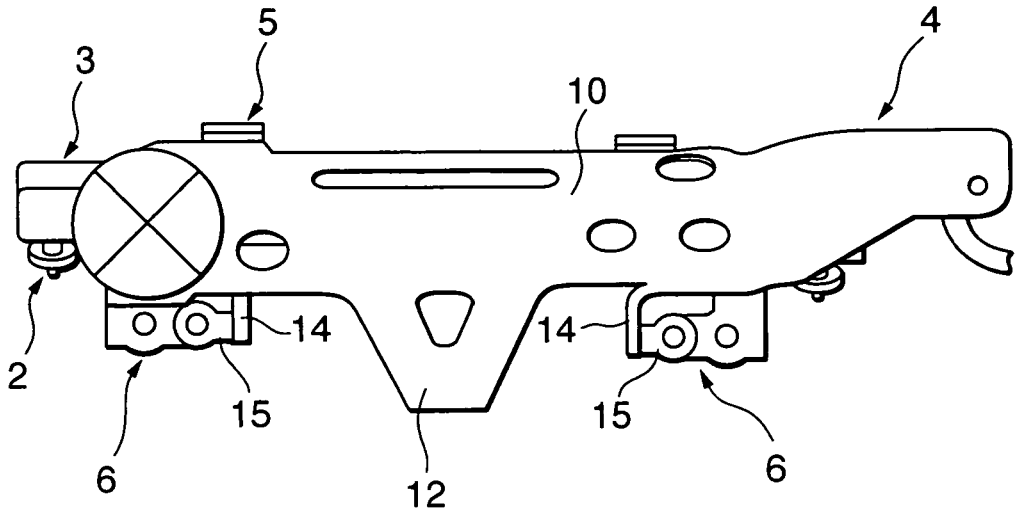
FIGS. 12A and 12B are similar to FIGS. 11A and 11B but show the path of deformation and displacement of the protective device resulting from an offset collision.
Figure 12B:
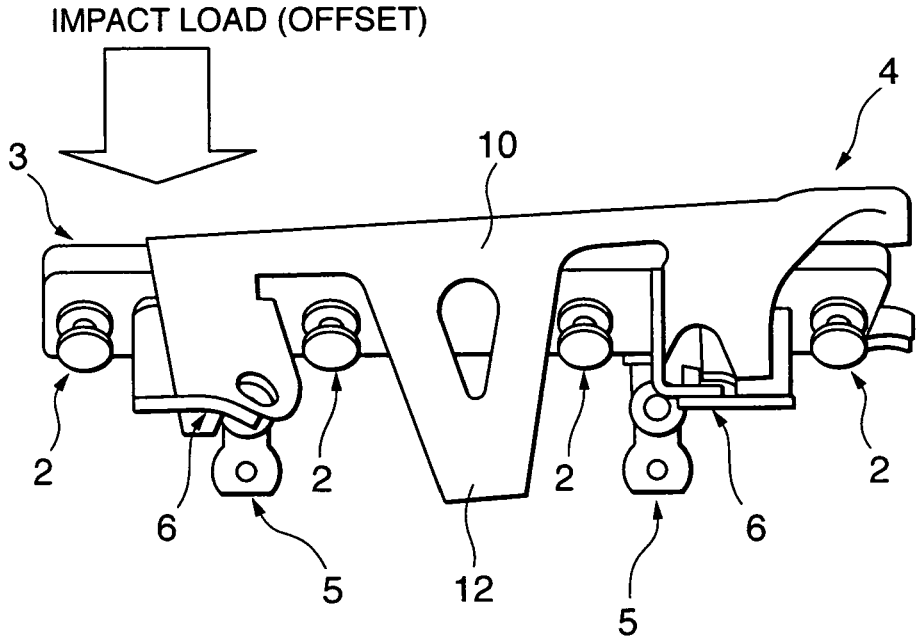

FIGS. 12A and 12B show an offset collision. During an offset collision, the tab 6B and the bending section 15 which are near to the point of application of an impact load undergo a greater flexural deformation than the other tab 6B and bending section 15. As a result, sections of the protector 4 which are near to the point of application of the impact load approach the engine 1. However since the respective ends of the tab 6A and the bending section 15 are bent, the protector 4 can only displace towards the engine 1.

Although the protector 4 and the engine 1 are not parallel to one another, the protector 4 does not displace to the right or the left in FIG. 12B. Thus even during an offset collision, the protective shell does not come into contact with the fuel supply pipe 3 and the stay 14 and the lower stopper 12 do not interfere with the fuel injectors 2.

Figure 13A:
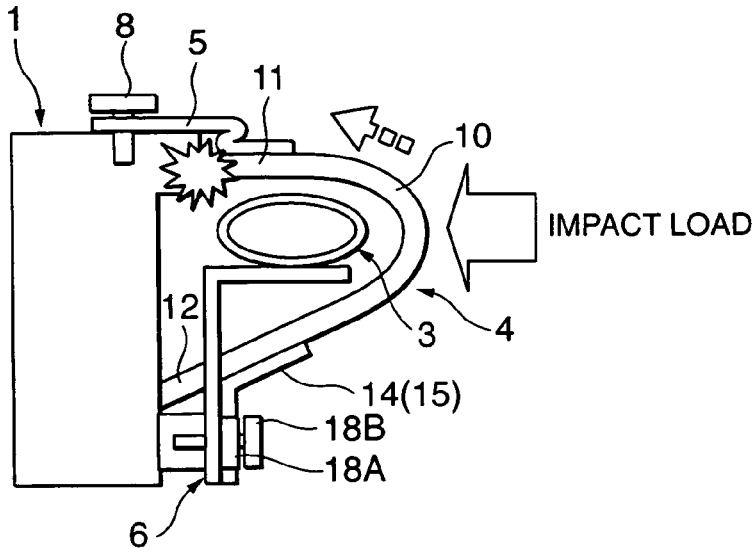
FIGS. 13A and 13B are a schematic cross-sectional view and a schematic horizontal sectional view of the fuel injector and the protective device mounted on the engine in order to show the protection structure of the protecting device associated with the engine when the protective device can not by itself absorb the load resulting from a collision.
Figure 13B:
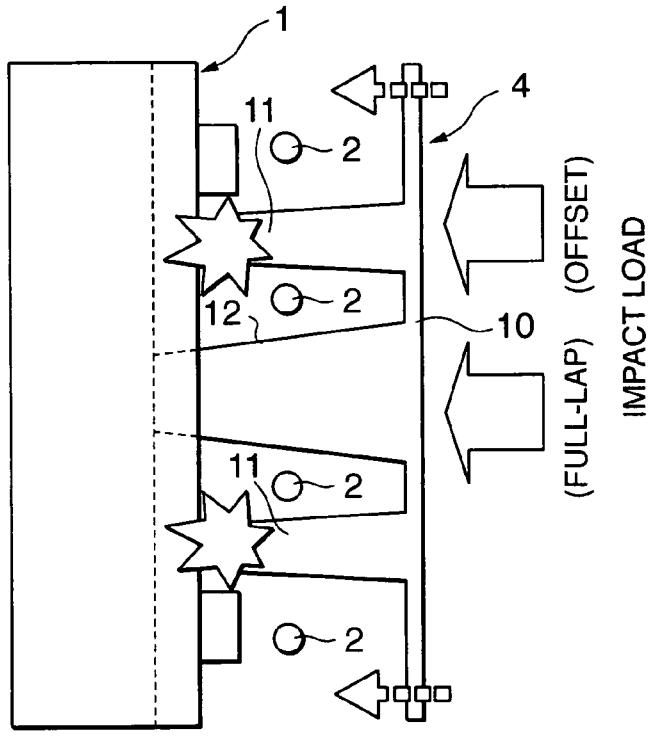

Next referring to FIGS. 13A and 13B, the deformation and displacement of members will be described when a larger impact load than that described in FIGS. 10A and 10B is applied to the protector 4.

When an impact load is not absorbed by the displacement and deformation of the members shown in FIGS. 10A and 10B, a further thrust towards the engine 1 is applied to the protector 4. Under these conditions, the further thrust is concentrated on the bracket 5 comprising the upper deformable member and a flexural deformation results in the bracket 5 as shown in FIG. 13A. This is due to the fact that the lower stopper 12 has already abutted with the wall face of the main section of the engine 1. As a result, the protector 4 absorbs the impact load by displacing obliquely upward toward the engine 1 or rotating in a counterclockwise direction in FIG. 13A.

As described above, the distance between the tips of the upper stopper 11 and lower stopper 12 and the wall face of the main body of the engine 1 is smaller than the predetermined gap set between the protective shell 10 and the fuel supply pipe 3. Thus even when the tips of the stoppers 11 and 12 as shown in FIGS. 13A and 13B respectively abut with the wall face of the main section of the engine 1, the protective shell 10 does not come into contact with the fuel supply pipe 3.

Thereafter the tips of the upper and lower stoppers 11 and 12 of the protector 4 abut with the wall face of the main body of the engine 1. Consequently the high rigidity of the protector 4 resulting from the integration with the engine 1 resists the impact load and prevents damage to the fuel supply pipe 3 and the fuel injectors 2.

As described above, the protective device according to this invention absorbs impact loads firstly as a result of deformation of the deformable members provided on the upper and lower sections of the protective shell 10 irrespective of whether the collision is a full-lapped collision or an offset collision. Load not absorbed at that stage is supported by the high rigidity of the protector 4. The two-stage protective structure described above effectively prevents damage to the fuel supply pipe 3 or the fuel injectors 2.

The structure and dimensions of the deformable members accurately regulate the direction and dimension of the displacement of the protector 4 resulting from an impact load. Irrespective of whether the collision is a full-lapped collision or an offset collision, there is no possibility of interference by the protector 4 with the fuel supply pipe 3 or the fuel injectors 2, since the protector 4 does not undergo deformation or displacement in an unexpected direction. Thus the layout of engine components such as the fuel supply pipe 3 or the fuel injectors 2 is simplified since the deformable members accurately defines the path of the motion by the protector 4.

This protective device fixes the protective shell 10 to the engine 1 using a pair of brackets 6. The connecting section of the bracket 6 and the protector 4 and the connecting section of the bracket 6 and the engine 1 are offset from each other in the transverse direction of the vehicle. Thus the connecting section of the bracket 6 and the protector 4 deform in response to an impact load and have the function of guiding the protective shell 10 only in a direction towards the engine 1. This guiding function greatly contributes to the accurate regulation of the path of the motion of the protective shell 10.

Furthermore the bracket 5 comprising flat plate and forming the upper deformable member only deforms in a direction in which the plate bends under a load. The bracket 5 therefore also has the function of guiding the protective shell 10 only in a direction of approaching the engine 1. Consequently the protector 4 deforms in a preset fixed pattern irrespective of the point of application of the load and therefore interference with the fuel supply pipe 3 or the fuel injectors 2 can be avoided.

In this protective device, the amount of energy of the collision which can be absorbed can be arbitrarily set by setting the rigidity of the deformable members.

Furthermore since the rigidity of the lower deformable member is set to be lower than the rigidity of the upper deformable member in this protective device, the energy of the collision can be absorbed by deformation firstly of the lower deformable member. In the event that energy remains unabsorbed, the remaining energy of the collision can subsequently absorbed by the deformation of the upper deformable member.

Thereafter the protective structure becomes highly rigid due to integration with the engine 1 resulting from the abutment of the stoppers 11 and 12 with the engine 1. Therefore it is possible to ensure protection of the fuel supply pipe 3 and the fuel injectors 2 with this type of multi-layered energy absorbing structure.

In this protective structure, the bracket 5 forming the upper deformable member supports the protective shell 10 using the upper stopper 11. The tab 6A and the bending member 15 forming the lower deformable member support the protective shell 10 using the sub-stopper 13. Although these deformable members can directly support the protective shell 10, it is possible to decrease the longitudinal dimensions of the bracket 5 or the bracket 6 which comprises the tab 6A through the upper stopper 11 or the sub-stopper 13. This structure enables the space occupied by the deformable members to be reduced while reducing the possibility that the deformable members will interfere with the objects to be protected.

The contents of Tokugan 2004-199246, with a filing date of Jul. 6, 2004 in Japan, are hereby incorporated by reference.

Although the invention has been described above by reference to certain embodiments of the invention, the invention is not limited to the embodiments described above. Modifications and variations of the embodiments described above will occur to those skilled in the art, within the scope of the claims.

For example, In the above embodiment, although the tab 6A is formed on the bracket 6 supporting the fuel supply pipe 8 on the engine 1, it is possible to support the tab 6A on the engine 1 using a separate independent bracket.

In the above embodiment, although the fuel supply pipe 3 and the fuel injectors 2 comprise the object for protection, this invention may be applied for the protection of any other engine components disposed outside the engine main body.

In the above embodiment, the upper stopper 11 is disposed at two positions on the upper section of the protective shell 10. The lower stopper 12 is provided at one position on the lower section of the protective shell 10. However the disposition of the stoppers 11-13 can be arbitrarily varied in response to the shape and disposition of the external component which is to be protected. This includes disposing the upper stopper 11 at three or more positions on the upper section of the protective shell 10 or disposing the lower stopper 12 at a plurality of positions on the lower section of the protective shell 10. It should be noted that this invention can be realized with at least one single stopper and one single deformable member.

In the above embodiment, although the stoppers 11-13 is integrated with the protective shell 10, one or more of the stoppers 11-13 may be formed by a member which is separate from the protective shell 10 and can be fixed to the protective shell 10.

In the above embodiment, the engine component to be protected is positioned in front of the engine 1. However even when the engine component to be protected is behind the engine 1, the protective device can display the same preferred effect with respect to a collision by reversing the longitudinal positions.

In the above embodiment, the upper and lower deformable members are used to adsorb the impact load due to vehicle collision, but the protector provided with only the upper or lower deformable member will bring a considerable effect on the protection of the engine component.

What is claimed is:

1. A protective device protecting an engine component disposed near a side face of an internal combustion engine for a vehicle, the device comprising:

a protective shell covering the engine component from an opposite direction from the engine;

a stopper limiting displacement of the protective shell towards the engine from exceeding a predetermined distance; and a deformable member deforming in response to an impact load applied to the protective shell and guiding displacement of the protective shell towards the engine up to a position limited by the stopper.

2. The protective device as defined in claim 1, wherein a distance between the protective shell and the engine component is set to be equal to or greater than the predetermined distance.

3. The protective device as defined in claim 1, wherein the stopper comprises a stopper which is integrated with the protective shell, the stopper comprising a tip facing the engine and defining interval which is equal to the predetermined distance, the tip of the stopper abutting with the engine in order to limit the displacement of the protective shell towards the engine from exceeding the predetermined distance.

4. The protective device as defined in claim 3, wherein the deformable member has a rigidity which is lower than the protective shell and the stopper.

5. The protective device as defined in claim 1, wherein the protective device further comprises a pair of brackets each having a connecting point connected with the engine and separated from the engine with respect to the direction of vehicle motion, the deformable member comprises a pair of tabs respectively fitted to the pair of the brackets, each of the tabs supporting a lower end of the protective shell at a supporting point which is laterally offset from the connecting point such that a distance between the supporting points of the pair of the brackets is shorter than a distance between the connecting points of the pair of the brackets and that each of the tabs is adapted to undergo a flexural deformation in response to an impact load applied to the protective shell.

6. The protective device as defined in claim 5, wherein the stopper comprises a stopper protruding from the lower end of the engine between the pair of the brackets.

7. The protective device as defined in claim 6, wherein the deformable member further comprises a pair of second brackets each connecting the engine with an upper end of the protective shell and comprising a flat plate, the pair of the second brackets separated laterally from each other with respect to the direction of vehicle motion.

8. The protective device as defined in claim 7, wherein the stopper further comprises a pair of second stoppers protruding from the upper end of the protective shell towards the engine, the pair of second stoppers limiting displacement of the protective shell towards the engine from exceeding the predetermined distance by abutting with the engine, the pair of second brackets connecting the pair of second stoppers with the engine.

9. The protective device as defined in claim 8, wherein the rigidity of the tabs formed on the pair of first brackets is set to be lower than the rigidity of the pair of second brackets.

10. The protective device as defined in claim 1, wherein the device is adapted to protect an engine component that is disposed in front of or behind the vehicle engine with respect to a direction of vehicle motion.

* * * * *